United States Patent [19]

Delucia

[11] Patent Number: 4,501,200

[45] Date of Patent: Feb. 26, 1985

[54] TAMPING TOOL RETAINER

[75] Inventor: Anthony Delucia, West Columbia, S.C.

[73] Assignee: Canron Corp., West Columbia, S.C.

[21] Appl. No.: 450,512

[22] Filed: Dec. 17, 1982

[51] Int. Cl.[3] ..... E01B 27/16; A01B 35/22; A01B 1/22; E01C 19/30

[52] U.S. Cl. ..... 104/10; 172/753; 299/93; 403/16; 403/370; 404/133

[58] Field of Search ..... 104/10, 12, 13, 14; 172/40, 49.5, 59, 111, 526, 762, 753; 173/132; 175/413; 299/93; 403/16, 177, 261, 334, 345, 360, 361, 370; 404/133

[56] References Cited

U.S. PATENT DOCUMENTS

| | | | |
|---|---|---|---|
| 2,487,696 | 11/1949 | Coffing | 172/762 X |
| 2,726,871 | 12/1955 | Schnellmann | 104/10 X |
| 3,177,813 | 4/1965 | Stewart | 104/12 |
| 3,581,664 | 6/1971 | Kruse et al. | 104/10 |
| 3,677,187 | 7/1972 | Stewart | 104/10 |
| 3,774,687 | 11/1973 | Van Der Lely | 172/111 X |
| 4,002,209 | 1/1977 | Van Der Lely | 172/762 |

*Primary Examiner*—Randolph Reese
*Assistant Examiner*—David F. Hubbuch
*Attorney, Agent, or Firm*—Russell S. Smart

[57] ABSTRACT

There is described a vibrating railroad ballast tamping tool head which provides ease of replacement of tamping tools, in the field. The head according to a preferred embodiment has a tamping tool holder mounted centrally on the end of a tool drive shaft, a pair of spaced tamping tool-shank receiving sockets being provided in the holder one on either side of the drive shaft and open to the underside of the holder. A pair of tamping tools each having a lower ballast engaging working face and an upper shank are located by means of tapered bores and key ways within each of the sockets and a tamping tool retaining yoke engages the shanks of both tamping tools underneath the tool holder and locks the tools to the holder by means of a centrally disposed bolt which is received in a blind bolt hole in the holder and draws up to force the tools into the sockets and to lock them therein.

7 Claims, 1 Drawing Figure

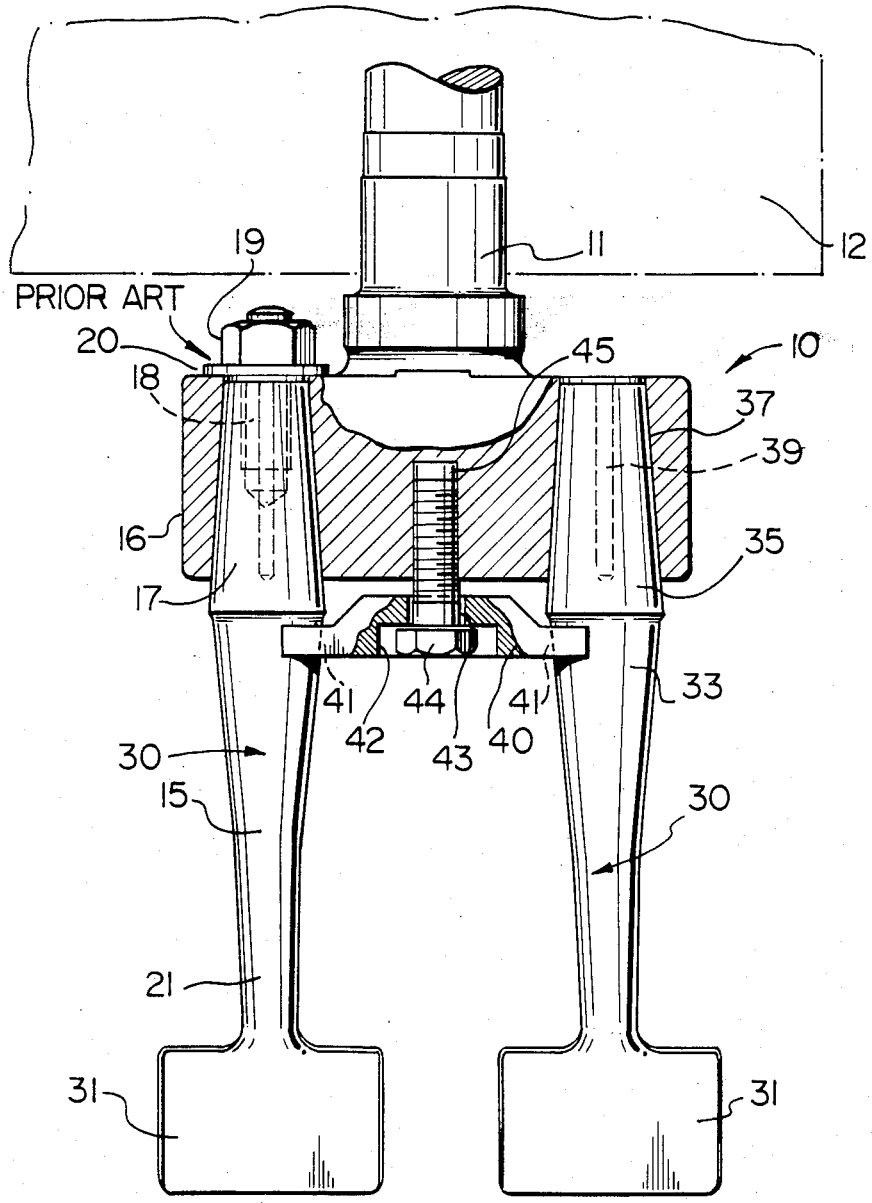
PRIOR ART
19
11
12
20
18
45
10
37
39
16
35
17
41
44
41'
33
42
43
40
30
15
30
21
31
31

TAMPING TOOL RETAINER

BACKGROUND OF THE INVENTION

The present invention relates to vibrating railway ballast tamping tools and more particularly to devices for retaining the tamping tools in the tamping tool head.

Vibrating tools, particularly those of the oscillatory type, have enjoyed great popularity in the railroad industry due to being used as positive amplitude impact tools working from a completely enclosed vibrator gearbox.

Normal wear and tear of the tool blade in the railroad ballast makes it necessary to repeatedly replace the tamping tools with either new tools or resurfaced tools, at frequent intervals. The replacement requires the disassembly of the tools from the tool holders of the head. The tool holders have to be in close proximity to the vibrator housing (this is particularly true of the oscillatory type) and this allows very limited space for fastening devices, such as studs and nuts, between the underside of the vibrator housing and the tops of the tool holders.

Furthermore, as the tamping tools are mounted to the tamping tool heads underneath a railroad ballast tamping machine, access to the tools is very limited and the time required to change the tamping tools, often after only one or two weeks operation, is considerable and costly.

It is an object of the present invention to provide a tamping tool head arrangement which is relatively cheap and simple and which requires relatively less time to replace a set of tamping tools than the time required with present tamping heads.

SUMMARY OF THE INVENTION

The present invention provides a vibrating railway ballast tamping tool head comprising a tool holder; a pair of spaced tamping tool-shank receiving sockets in the tool holder open at least to the underside of the holder; a pair of tamping tools each having a lower working face and an upper shank; and tamping tool retaining means for engaging the shanks of both tamping tools, underneath the tool holder, and for connection to the holder to lock the located tools in the sockets.

In a preferred embodiment, means is provided for locating a tamping tool-shank within each of the sockets.

Preferably, the means for locating a tamping tool-shank within each of the sockets is a key and key way combination.

Preferably also, the tool-shanks have decreasingly tapered frusto-conical upper ends and carry part of the key and key way combination. Conveniently, each socket has an inwardly tapered socket wall surface adapted to mate with a correspondingly tapered tamping tool-shank, and provides a corresponding part of the key and key way combination.

Also, according to a preferred embodiment, the tamping tool retaining means may comprise a yoke with tamping tool shank-engaging surfaces adjacent each end, a central bolt receiving recess, and a locking bolt for operative engagement in the recess and in a correspondingly threaded bolt receiving hole in the underside of the holder member.

The following is a description by way of example of one embodiment of the present invention as it is applied to an oscillatory vibrating tamping tool head of known type, reference being had to the accompanying drawing, which is a part view, in elevation and partial section, of the ballast working end of the head.

Turning now to the drawing, the tamping tool head 10 is mounted in conventional fashion and is shown with the end of an oscillating drive shaft 11 protruding from the vibrator housing 12.

On the left hand side of the drawing is shown the prior art fashion of fixing a tamping tool 15 to the tamping tool holder 16. In the prior art, the upper part of a tamping tool-shank 17 was provided with a threaded stud 18 and by means of a locknut 19 and washer 20, was used to secure the tool 21 in the holder 16. As will be immediately apparent, the clearance between the bottom of the vibrator housing 12 and the locknut and threaded stud 18, 19 is very small. It was in this area that technicians changing tamping tools had to work with open wrenches to remove the locknut 19 from the stud 18 to remove the tool 15 with its integral blade 21. After removal of the nut 19 a blow was applied to the lower blade of the tool 21 to loosen the seat of the tool-shank. Subsequently the threaded studs 18 would be exposed to impact when handling the tool and the stud thread could easily be damaged, requiring replacement.

In contrast, the present invention provides a construction in which more operating room is provided for the technician working to replace the tamping tools and the construction of the head has been greatly simplified.

In the embodiment of the invention shown, a pair of tamping tools 30 have hardened lower working faces 3 which engage in the ballast in operation, and upper shanks 33. The shanks 33 have decreasingly tapered frusto-conical upper ends 35 and the tamping tool holder 16 is provided with a pair of tamping tool receiving sockets 37 spaced equally on either side of the drive shaft 11 and open at least to the underside of holder 16. The receiving sockets 37 have inwardly tapered socket wall surfaces adapted to mate with correspondingly tapered tamping tool-shanks 35. A key way and key arrangement 39 is provided in the socket wall and in the corresponding tool-shank so as to locate the blade, within its socket, in its proper relation to the vibrating tool shaft 11.

In order to retain the tamping tools 30 in their sockets, a retaining means, a yoke 40 in the embodiment shown herein, is positioned beneath the tool holder 16 and by means of contoured shank-engaging surfaces 41, at each outer end of the yoke 40, engage the shanks 33 of both tamping tools 30. Centrally of the yoke 40 is a bolt receiving recess 42, open at 43, to receive a locking bolt 44. The tool holder 16 is provided centrally thereof with a threaded blind hole 45 to receive the bolt 44. Simply by tightening the bolt 44 the yoke 40 is caused to draw up on the shanks 33 of the tamping tools 30 and to force them into snug mating engagement within the sockets.

When it is required to change the tools, a technician is provided with easy access from below where a socket wrench can be used to loosen bolt 44 and the yoke, for easy removal of the tools 30.

While the foregoing description has been of an example of the application of the invention to oscillatory vibrating tamping tool heads, it will be clear to those skilled in the art that the invention is applicable to other types of vibrating ballast tamping tool heads.

What I claim as my invention is:

1. A vibrating railway ballast tamping tool head comprising a tool holder; a pair of spaced tamping tool-shank receiving sockets in said tool holder open at least to the underside of said holder; a pair of tamping tools each having a lower working face and an upper shank; and tamping tool retaining yoke means for engaging the shanks of both tamping tools underneath said tool holder and for connection to said holder to lock said located tools in said sockets.

2. Apparatus as claimed in claim 1 further comprising means for locating a tamping tool-shank within each of the said sockets.

3. Apparatus as claimed in claim 2 in which said means for locating a tamping tool-shank within each of said sockets is a key and key way combination.

4. Apparatus as claimed in claim 3 in which each tool-shank has a decreasingly tapered frusto-conical upper end and carries part of said key and key combination.

5. Apparatus as claimed in claim 4 wherein each socket has an inwardly tapered socket wall surface adapted to mate with a correspondingly tapered tamping tool-shank, and provides a corresponding part of said key and key combination.

6. An oscillatory vibrating railway ballast tamping tool head comprising a tool drive shaft; a tamping tool holder mounted centrally on and beneath a bottom end of said drive shaft; a pair of spaced tamping tool-shank receiving sockets in said tool holder disposed one on either side of said drive shaft and open at least to the underside of said holder; a pair of tamping tools each having a lower working face and an upper shank; means for locating a tamping tool-shank within each of said sockets; and tamping tool retaining yoke means for engaging the shanks of both tamping tools underneath said tool holder and for connection to said holder to lock said located tools in said sockets.

7. A vibrating railway ballast tamping tool head comprising a tool holder; a pair of spaced tamping tool-shank receiving sockets in said tool holder open at least to the underside of said holder; a pair of tamping tools each having a lower working face and an upper shank; and tamping tool retaining means comprising a yoke with tamping tool shank-engaging surfaces adjacent each end to engage a shank of each tamping tool, when located in said sockets, underneath said tool holder, a central bolt receiving recess, and a locking bolt for operative engagement in said recess and in a correspondingly threaded bolt-receiving hole in the underside of said holder, to lock said located tools in said sockets.

* * * * *